US007758385B2

(12) United States Patent
Davis et al.

(10) Patent No.: US 7,758,385 B2
(45) Date of Patent: Jul. 20, 2010

(54) ORTHOGONAL ELECTRICAL CONNECTOR AND ASSEMBLY

(75) Inventors: Wayne Samuel Davis, Harrisburg, PA (US); Robert Neil Whiteman, Jr., Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 308 days.

(21) Appl. No.: 12/044,595

(22) Filed: Mar. 7, 2008

(65) Prior Publication Data

US 2009/0227145 A1 Sep. 10, 2009

(51) Int. Cl.
*H01R 24/00* (2006.01)

(52) U.S. Cl. ..... 439/626; 439/941

(58) Field of Classification Search ..... 439/626, 439/701, 941

See application file for complete search history.

(56) References Cited

U.S. PATENT DOCUMENTS

| | | | |
|---|---|---|---|
| 4,703,394 | A | 10/1987 | Petit et al. |
| 5,429,521 | A | 7/1995 | Morlion et al. |
| 6,227,882 | B1 | 5/2001 | Ortega et al. |
| 6,347,962 | B1 | 2/2002 | Kline |
| 6,371,773 | B1 | 4/2002 | Crofoot et al. |
| 6,447,340 | B1 | 9/2002 | Wu |
| 6,607,401 | B1 | 8/2003 | Weaver, Jr. et al. |
| 6,607,402 | B2 | 8/2003 | Cohen et al. |
| 6,717,825 | B2 | 4/2004 | Volstorf |
| 6,758,695 | B2 | 7/2004 | Pepe et al. |
| 6,780,059 | B1 | 8/2004 | Payne et al. |
| 6,988,902 | B2 | 1/2006 | Winings et al. |
| 7,108,556 | B2 | 9/2006 | Cohen et al. |
| 7,331,802 | B2 | 2/2008 | Rothermel et al. |
| 2004/0092140 | A1 | 5/2004 | Mashiyama et al. |
| 2005/0070160 | A1 | 3/2005 | Cohen et al. |
| 2005/0148239 | A1 | 7/2005 | Hull et al. |
| 2006/0024983 | A1 | 2/2006 | Cohen et al. |
| 2006/0024984 | A1 | 2/2006 | Cohen et al. |
| 2006/0073709 | A1 | 4/2006 | Reid |
| 2007/0021001 | A1 | 1/2007 | Laurx et al. |
| 2007/0099455 | A1 * | 5/2007 | Rothermel et al. ..... 439/108 |
| 2008/0045079 | A1 | 2/2008 | Minich et al. |

(Continued)

FOREIGN PATENT DOCUMENTS

EP 1 049 201 A1 11/2000

(Continued)

OTHER PUBLICATIONS

European Search Report, EP Application No. EP 09154401.5, International Filing Date Mar. 5, 2009.

*Primary Examiner*—James Harvey

(57) ABSTRACT

An electrical connector includes a housing having a mating face and a mounting face. A plurality of signal contacts are held by the housing with the signal contacts being arranged in differential pairs to form signal contact pairs. Each signal contact has a body, a contact pin extending from one end of the body along a pin axis and a contact tail extending from an opposite end of the body. The body extends along a contact plane. The contact pin includes a transition section that offsets the contact pin out of the contact plane in a first lateral direction. The contact tail lies in the contact plane and is off-set in a transverse direction with respect to the pin axis.

17 Claims, 11 Drawing Sheets

U.S. PATENT DOCUMENTS

2009/0227145 A1* 9/2009 Davis et al. ..... 439/626

FOREIGN PATENT DOCUMENTS

EP 1 220 361 A1 7/2002
EP 1 398 852 A1 3/2004
EP 1 783 871 A1 10/2006
WO WO 03/043138 A1 5/2003

* cited by examiner

ORTHOGONAL ELECTRICAL CONNECTOR AND ASSEMBLY

BACKGROUND OF THE INVENTION

The subject matter herein relates generally to electrical connectors and, more particularly, to a connector that may be used in an orthogonal relationship with an identical connector on both sides of a midplane.

Some electrical systems, such as network switches and computer servers with switching capability, include connectors that are oriented orthogonally on opposite sides of a midplane in a cross connect application. Switch cards may be connected on one side of the midplane and line cards may be connected on the other side of the midplane. The line card and switch card are joined through connectors that are mounted on opposite sides of the midplane. Typically, traces are provided on the sides and/or the layers of the board to route the signals between the connectors. Sometimes the line card and switch card are joined through connectors that are mounted on the midplane in an orthogonal relation to one another. The connectors include patterns of signal and ground contacts that extend through a pattern of vias in the midplane.

However, conventional orthogonal connectors have experienced certain limitations. For example, it is desirable to increase the density of the signal and ground contacts within the connectors. Heretofore, the contact density has been limited in orthogonal connectors, due to the contact and via patterns. Conventional contact and via patterns of an orthogonal connection are formed symmetric about a forty-five degree axis with respect to columns or rows of the contacts. The symmetric arrangement limits the density of the signal and ground contacts in conventional orthogonal connectors. For example, in differential applications where signal contacts are arranged in a plurality of differential pairs, a distance, sometimes referred to as a pitch, between adjacent signal pairs has been determined based on a space needed for each differential pair and an associated ground(s). In conventional connectors, the pitch is a square grid such that the row to row pitch is the same as the column to column pitch in order to use the same connector design on each side of the midplane, which may be desirable to reduce a cost and/or a complexity of the orthogonal connector.

A need remains for an improved orthogonal connector that increases contact and via density in differential pair applications.

BRIEF DESCRIPTION OF THE INVENTION

In one embodiment, an electrical connector is provided that includes a housing having a mating face and a mounting face. A plurality of signal contacts are held by the housing with the signal contacts being arranged in differential pairs to form signal contact pairs. Each signal contact has a body, a contact pin extending from one end of the body along a pin axis and a contact tail extending from an opposite end of the body. The body extends along a contact plane. The contact pin includes a transition section that off-sets the contact pin out of the contact plane in a first lateral direction. The contact tail lies in the contact plane and is off-set in a transverse direction with respect to the pin axis.

Optionally, the contact pins within the signal contact pair may be off-set from the bodies in opposite directions. The contact tails within the signal contact pair may be off-set with respect to the pin axes in the same direction. Each contact pin may extend generally parallel to the contact plane and may be off-set from the contact plane. Optionally, the pin axis may be substantially centered with respect to the body. Each differential pair may include a first signal contact and a second signal contact, wherein one of the contact tail and the contact pin of the first signal contact may be off-set in an opposite direction as compared to the second signal contact.

In another embodiment, an electrical connector assembly is provided including a pair of connectors configured to be electrically connected to one another from opposite sides of a circuit board. The electrical connector assembly includes first and second connector housings each having a mating interface and a mounting interface. The mounting interfaces are configured to be electrically connected to one another from opposite sides of the circuit board approximately in line with one another along a longitudinal axis such that the connector housings are angularly offset ninety degrees about the longitudinal axis with respect to one another. Signal and ground contacts are held in the first and second connector housings, wherein the signal contacts are arranged in differential pairs to form signal contact pairs. Each signal contact has a signal contact tail off-set with respect to a centerline of the signal contact and each ground contact having a ground contact tail off-set with respect to a centerline of the ground contact. The signal and ground contacts are configured to be received in respective vias in the circuit board such that the signal contact tails of corresponding signal contacts of the first connector and the second connector are received in a shared via. Optionally, the ground contact tails of corresponding ground contacts of the first connector and the second connector may be received in a shared via.

In a further embodiment, an electrical connector is provided including a plurality of signal contacts being arranged in differential pairs to form signal contact pairs. Each signal contact has a body, a contact pin extending from one end of the body and a contact tail extending from an opposite end of the body. The contact pins are substantially centered with respect to the body and the contact tails are non-centered with respect to the body. The electrical connector also includes a header housing having an end wall defining a mounting face, wherein the end wall has a plurality of contact cores extending therethrough that receive the signal contacts. The contact cores are aligned in a pattern of rows and columns, and each contact core has a base section that receives the body of the signal contact and a head section that receives the contact pin of the signal contact. The head sections are substantially centered along the base sections, and the head sections are aligned with one another along row axes and column axes such that the contact pins are aligned with one another. The contact cores along the column axes are arranged such that the base sections of contact cores holding a signal contact pair are staggered on opposite sides of the respective column axes.

DETAILED DESCRIPTION OF THE INVENTION

Figure 1:
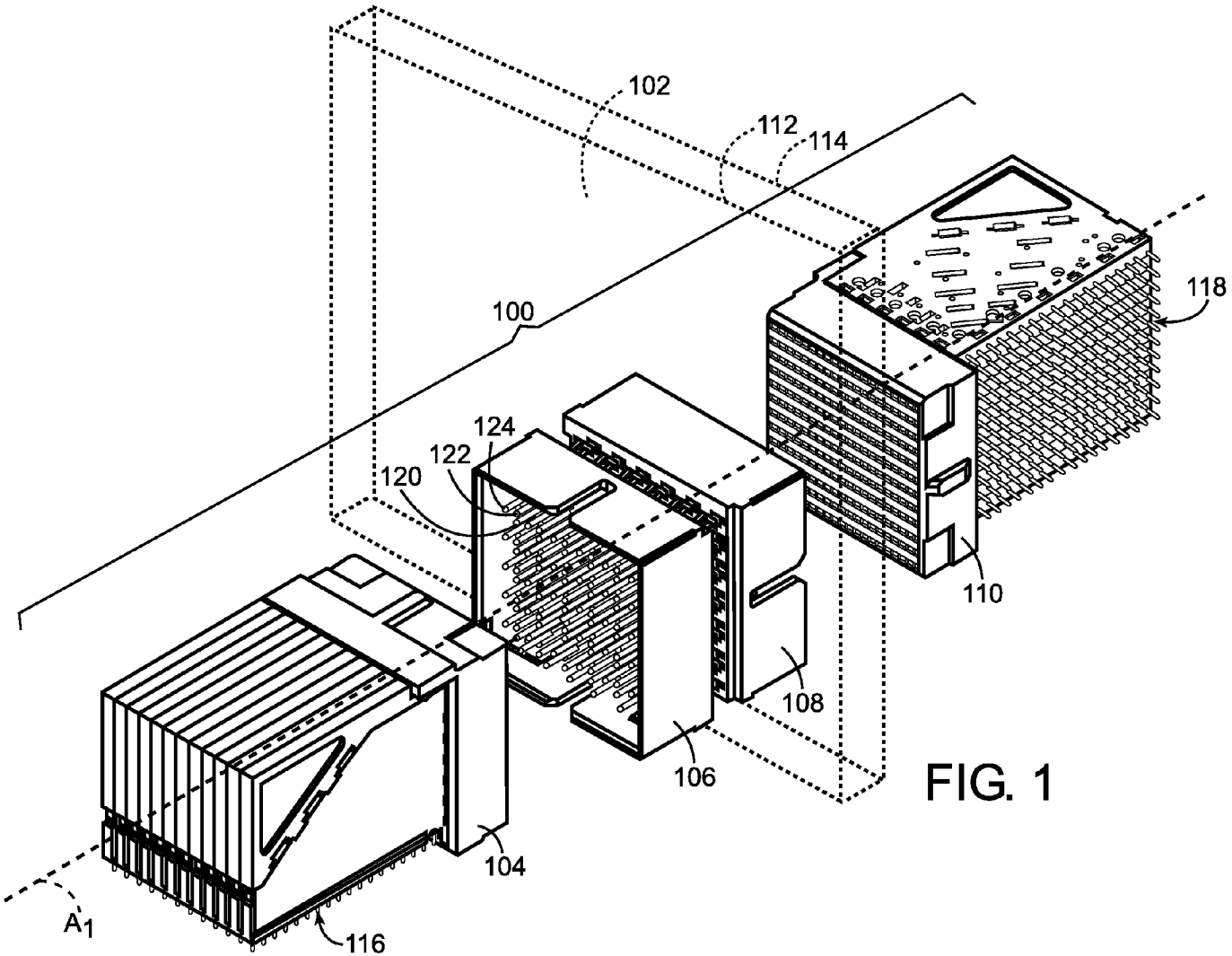
FIG. 1 is a perspective view of an exemplary orthogonal connector assembly having a pair of header connectors and a pair of receptacle connectors formed in accordance with an exemplary embodiment.

FIG. 1 is a perspective view of an orthogonal connector assembly 100 formed in accordance with an exemplary embodiment. The connector assembly 100 is mounted on a midplane circuit board 102, which is shown in phantom lines for clarity. The connector assembly 100 includes a first receptacle connector 104, a first header connector 106, a second header connector 108, and a second receptacle connector 110. The first header and receptacle connectors 106, 104 are mounted on a first side 112 of the midplane 102 and connect through the midplane 102 to the second header and receptacle connectors 108, 110, which are mounted on a second side 114 of the midplane 102.

The first receptacle connector 104 includes a daughter card interface 116. By way of example only, the first receptacle connector 104 may be mounted on a line card (not shown) at the interface 116. Similarly, the second receptacle connector 110 includes a daughter card interface 118 and, by way of example only, the second receptacle connector 110 may be mounted on a switch card (not shown) at the interface 118. The connector assembly 100 includes a longitudinal axis $A_1$ that extends from the first receptacle connector 104 through the second receptacle connector 110. Optionally, the receptacle connectors 104, 110 may be identical to one another. Also, the header connectors 106, 108 may be identical to one another.

The header connectors 106, 108 are oriented approximately in line with one another along the longitudinal axis $A_1$, and the header connectors 106, 108 are angularly offset ninety degrees about the longitudinal axis $A_1$ with respect to one another to form an orthogonal connection therebetween. The receptacle connectors 104, 110 are likewise rotated ninety degrees about the longitudinal axis $A_1$ with respect to one another. In an exemplary embodiment, the header connectors 106, 108 include mating contacts in the form of two different types of signal contacts 120, 122 and also in the form of ground contacts 124. The header connectors 106, 108 each define a mating interface configured to mate with the corresponding receptacle connectors 104, 110, and each define a mounting interface configured to mate with the midplane circuit board 102. As described in further detail below, the mating interface is defined by the housing of the header connectors 106, 108 as well as the contacts 120, 122, 124. The mounting interface is similarly defined by the housing of the header connectors 106, 108 as well as the contacts 120, 122, 124. The structure and positioning of the signal contacts 120, 122 and the ground contacts 124 will be described in further detail below.

Although the embodiments will be described in terms of a connector assembly 100 as illustrated in FIG. 1, it is to be understood that the benefits herein described are also applicable to connector systems wherein a receptacle connector is mounted on a midplane circuit board or some other type of board or structure.

Figure 2:
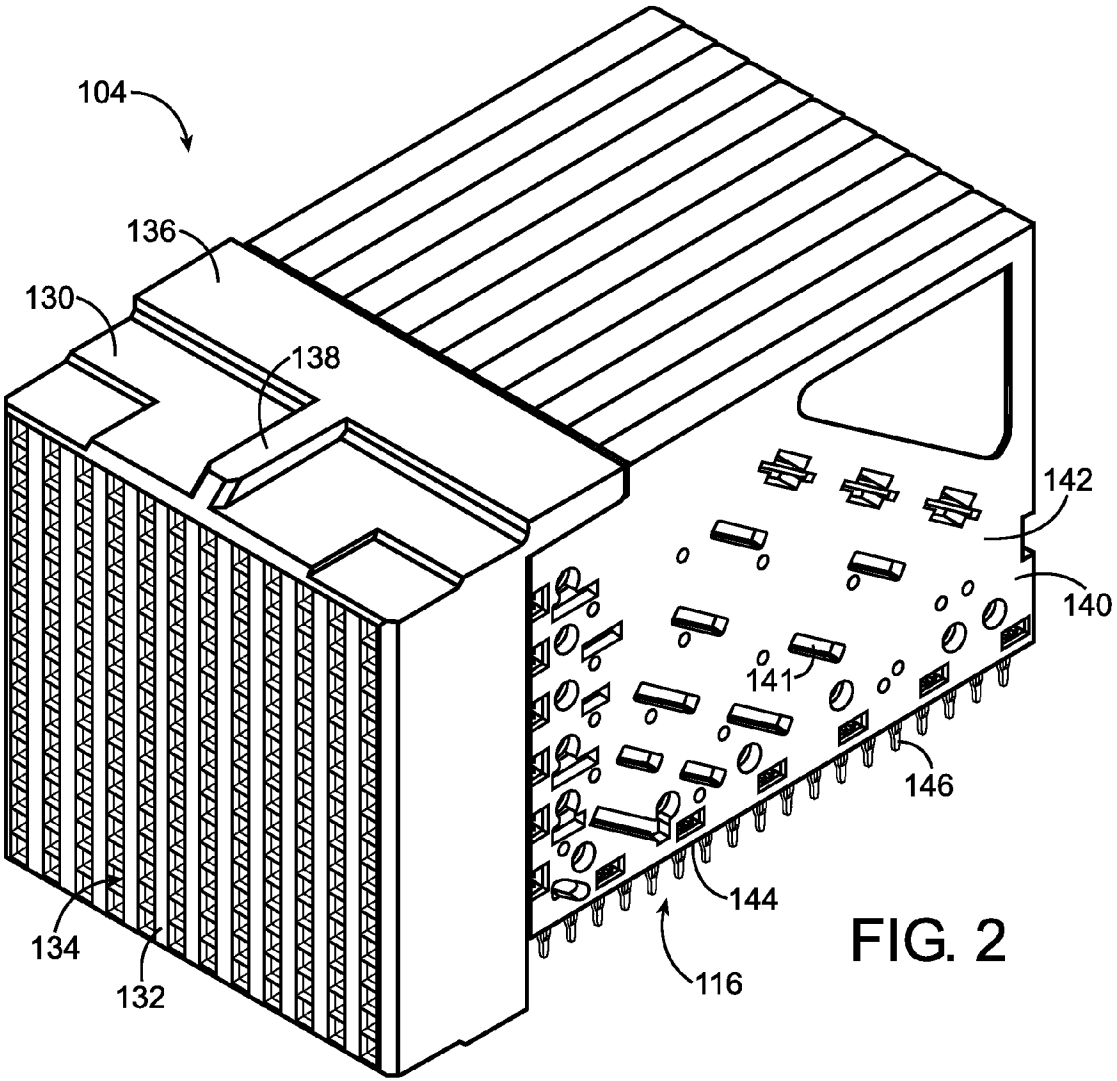
FIG. 2 is a perspective view of one of the receptacle connectors shown in FIG. 1 formed in accordance with an exemplary embodiment.

FIG. 2 is a perspective view of the first receptacle connector 104. The receptacle connector 104 includes a dielectric housing 130 that has a mating face 132 having a plurality of contact channels 134. The contact channels 134 are aligned with one another in columns and rows. The contact channels 134 are configured to receive mating contacts, such as the signal contacts 120, 122 and the ground contacts 124 (shown in FIG. 1), from a mating header connector such as, but not limited to, the header connector 106 (shown in FIG. 1). The receptacle connector 104 also includes an upper shroud 136 that extends rearwardly from the mating face 132. Guide ribs 138 are formed on opposite sides of the housing 130 to orient the receptacle connector 104 for mating with the header connector 106. The housing 130 receives a plurality of contact modules or chicklets 140 holding contacts and conductive paths that connect the daughter card interface 116 with the mating face 132. In an exemplary embodiment, the interface 116 is substantially perpendicular to the mating face 132 such that the receptacle connector 104 interconnects electrical components that are substantially at a right angle to each other. Other types of receptacle connectors 104 may be used in alternative embodiments, such as a cable connector.

Each contact module 140 includes a contact lead frame 141, only portions of which are visible, that is overmolded and encased in a contact module housing 142 fabricated from a dielectric material. The housing 142 has a forward mating end (not shown) that is received in the receptacle connector housing 120. Mating contacts (not shown) extend from the forward mating end and are positioned within the contact channels 134 for mating engagement with corresponding mating contacts of the header connector 106, such as the signal contacts 120, 122 and the ground contacts 124. In an exemplary embodiment, the signal contacts 120 and the ground contacts 124 are arranged in a predetermined pattern to provide a predetermined pin-out for the receptacle connector 104. For example, the contact module 140 may have a signal-signal-ground pattern, which is viewed from the bottom of the column of contact channels 134. Optionally, the signal contacts may be arranged in differential pairs to form signal contact pairs. Alternatively, the contact module 140 may have a ground-signal-signal pattern, which is viewed from the bottom of the column of contact channels 134. Other patterns may also be used, such as a ground-ground-signal-signal pattern or a signal-signal-ground-ground pattern, or other patterns. In an exemplary embodiment, adjacent contact modules 140 may have different patterns, such as a first contact module **140*a* having a signal-signal-ground pattern and a second contact module 140*b* having a ground-signal-signal pattern. The first and second contact modules 140*a*, 140*b* are alternatingly received within the housing 142**.

The housing 142 also includes a mounting edge 144 defining the daughter card interface 116 that is configured for mounting to a circuit board (not shown) or some other type of board or structure. Contact tails 146 extend from the lead frame within the contact module 140 and extend through the mounting edge 144 of the contact module 140 for attachment to the circuit board or other type of board or structure.

Figure 3:
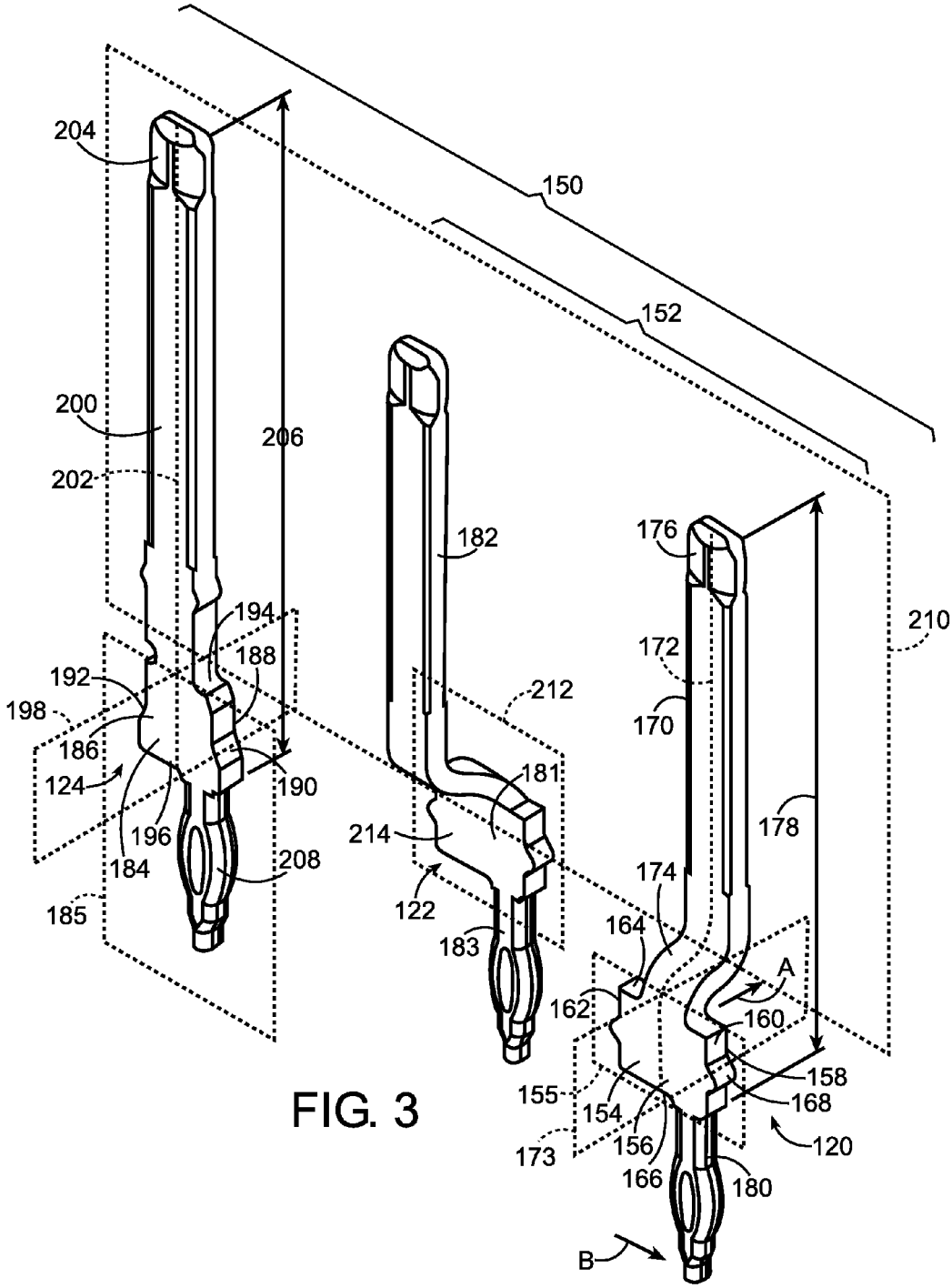
FIG. 3 illustrates a contact set for use with the header connectors shown in FIG. 1 having a first type of signal contact, a second type of signal contact, and a ground contact.

FIG. 3 illustrates a contact set 150 for use with the header connector 106 (shown in FIG. 1) having a first type of signal contact 120, a second type of signal contact 122, and a ground contact 124. Within the contact set 150, the signal contacts 120, 122 are arranged as a differential pair and form a signal contact pair 152. The ground contact 124 is provided to separate the signal contact pair 152 from an adjacent signal contact pair 152.

The signal contact 120 includes a planar contact body 154 that extends along a contact plane 155. The contact body 154 is bounded by opposed, generally planar sides 156, 158, opposed first and second edges 160, 162, and opposed inner and outer ends 164, 166. The edges 160, 162 and the ends 164, 166 extend between the sides 156, 158. Optionally, barbs 168 may be provided on the edges 160, 162 to hold the signal contact 120 within the header connector 106.

The signal contact 120 includes a signal contact pin 170 that extends outward from the inner end 164. The signal contact pin 170 generally extends along a pin axis 172 that is substantially centered with respect to the edges 160, 162. In one embodiment, the signal contact 120 defines a central plane 173 that is orthogonal to the contact plane 155 and that is centered between the edges 160, 162 of the contact body 154. Optionally, the pin axis 172 may be coincident with the contact plane 155. The signal contact pin 170 includes a transition section 174 proximate to the body 154 that off-sets the signal contact pin 170 out of plane with respect to the contact plane 155. That is, the signal contact pin 170 is generally parallel to, but non-planar with, the contact plane 155. The signal contact pin 170 is off-set in a lateral direction, shown by the arrow A, from the contact body 154. The transition section 174 is curved in two directions such that the signal contact pin 170 generally extends parallel to the contact plane 155, but off-set from the contact plane 155. In an exemplary embodiment, the signal contact pins 170 define a mating interface 176 proximate to a distal end of the signal contact pin 170 for mating engagement with the mating contacts of the receptacle connector 104 (shown in FIG. 1). The signal contact pins 170 have a length 178 measured from the outer end 166.

The signal contact 120 includes a signal contact tail 180 that extends outward from the outer end 166. The signal contact tail 180 generally extends in an opposite direction as the signal contact pin 170. The signal contact tail 180 is configured to mate with a via in the midplane circuit board 102 (shown in FIG. 1), as will be described in further detail below. In an exemplary embodiment, the signal contact tail 180 is a compliant pin, such as an eye-of-the-needle pin, that may be press fit into one of the vias in the midplane circuit board 102. The signal contact tail 180 is lying within the contact plane 155. While the signal contact tail 180 is generally co-planar with the contact body 154, the contact tail 180 is off-set in a transverse direction, shown by the arrow B, with respect to the central plane 173. The direction of off-set of the contact tail 180 is generally orthogonal to the direction of off-set of the contact pin 170. That is, the signal contact tail 180 is off-set with respect to the pin axis 172 of the signal contact pin 170 such that the signal contact tail 180 is not aligned with the signal contact pin 170. Optionally, the signal contact tail 180 may be off-set such that the signal contact tail 180 is positioned proximate one of the edges 160, 162 of the contact body 154.

The second signal contact 122 is substantially similar to the first signal contact 120. The second signal contact 122 includes a contact body 181, a contact pin 182 and a contact tail 183. The contact pin 182 is off-set with respect to the contact body 181. The contact tail 183 is off-set with respect to the contact pin 182.

In an exemplary embodiment, one of the contact pin 182 and the contact tail 183 are off-set differently as compared to the contact pin 170 and the contact tail 180 of the first signal contact 120. In other words, the first and second signal contacts 120, 122 are not identically formed. For example, as illustrated in FIG. 3, while both contact tails 180, 183 are off-set in a similar direction, the contact pins 170, 182 are off-set in different directions.

The ground contact 124 includes a planar ground contact body 184 that extends along a ground contact plane 185. The ground contact body 184 is bounded by opposed, generally planar sides 186, 188, opposed edges 190, 192, and opposed inner and outer ends 194, 196. The ground contact body 184 includes a central plane 198 that is orthogonal to the contact plane 185 and that is centered between the edges 190, 192 of the ground contact body 144.

The ground contact 124 includes a ground contact pin 200 that extends outward from the inner end 194 along a ground pin axis 202 that is substantially centered with respect to the edges 190, 192. Optionally, the ground pin axis 202 may be slightly off-set with respect to the central plane 198. Optionally, the ground pin axis 202 may be positioned proximate one of the edges 190, 192. The ground contact 124 is generally planar, with the ground contact pin 200 and the ground contact body 184 lying within the ground contact plane 185. In an exemplary embodiment, the ground contact pin 200 defines a mating interface 204 for mating engagement with a mating contact of the receptacle connector 104 (shown in FIG. 1). The ground contact pin 200 has a length 206 measured from the outer end 196. Optionally, the length 206 may be longer than the length 178 of the signal contact pins 170 such that the ground contact 124 is first to mate and last to break when the header connector 106 is mated and separated, respectively, with the receptacle connector 104.

The ground contact 124 includes a ground contact tail 208 that extends outward from the outer end 196. The ground contact tail 208 is generally co-planar with the ground contact body 184 and the ground contact pin 200. The ground contact tail 208 is off-set with respect to the pin axis 202 of the ground contact pin 200 such that the ground contact tail 208 is not aligned with the ground contact pin 200. The ground contact tail 208 is also off-set with respect to the central plane 198. Optionally, the ground contact tail 208 may be off-set such that the ground contact tail 208 is positioned proximate one of the edges 190, 192 of the contact body 184.

In an exemplary embodiment, the signal contacts 120, 122 and the ground contact 124 within the contact set 150 are arranged such that each of the contact pins 170, 182 200 are substantially aligned with one another along a pin plane 210. As such, because of the off-sets of the signal contact pins 170, 182 the pin plane 210 is provided between the contact plane 155 of the first signal contact and a contact plane 212 of the second signal contact 122. In an exemplary embodiment, the signal contact pins 170, 182 within the contact pair 152 are off-set from the bodies 154, 181 in opposite directions. For example, the signal contact pin 170 of the first signal contact 120 is off-set in the direction of the second side 158, while the signal contact pin 182 of the second signal contact 122 is off-set in the direction of a first side 214 of the second signal contact 122. In an exemplary embodiment, the signal contact tails 180, 183 within the contact pair 152 are off-set with respect to the central planes 173 and 216 for the second signal contact 122 in the same direction, such as in a direction away from the ground contact 124.

Figure 4:
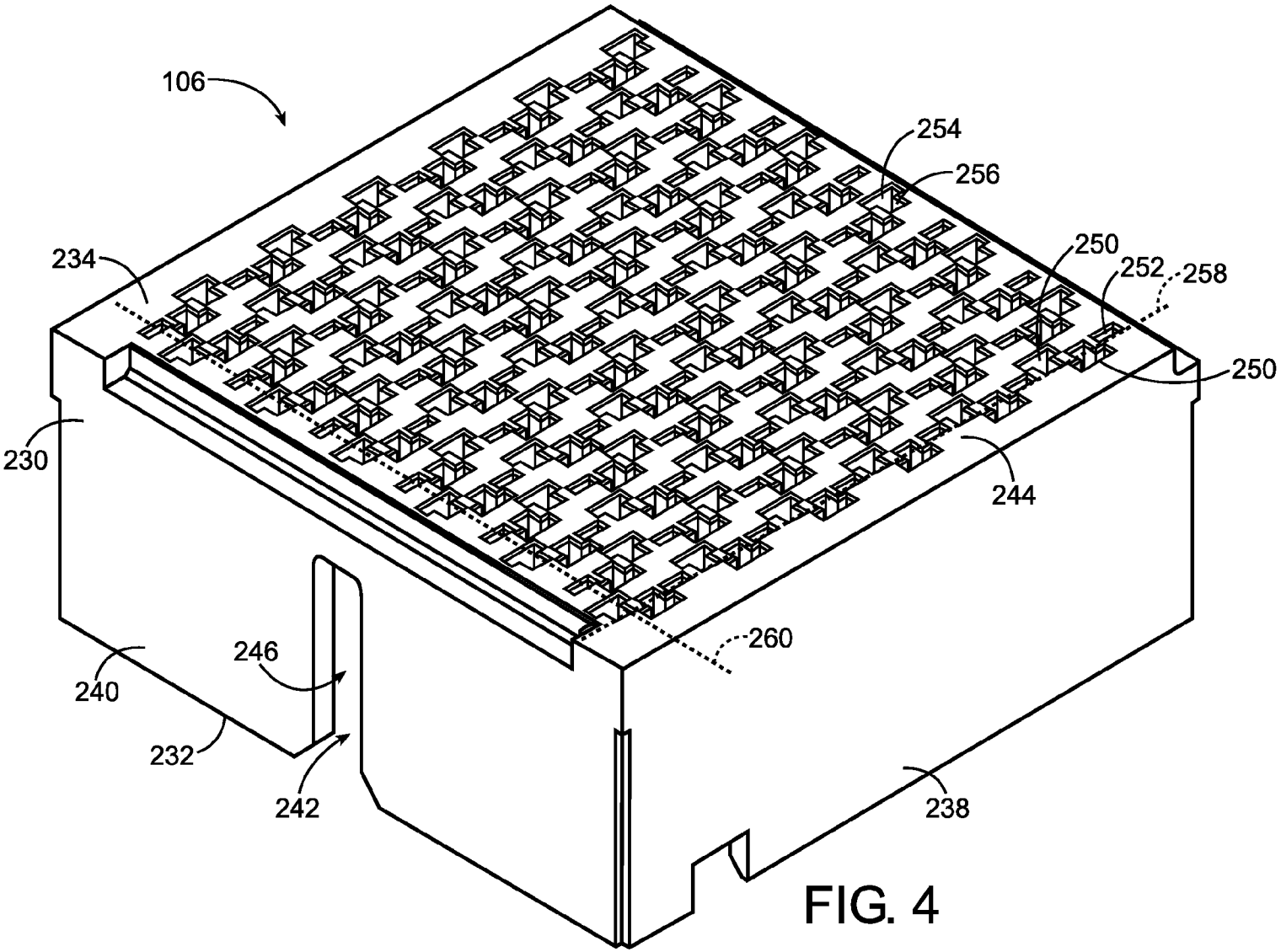
FIG. 4 is a bottom perspective view of the header connector shown in FIG. 1 with the contacts removed.

FIG. 4 is a bottom perspective view of the header connector 106 with the signal and ground contacts 120, 122, 124 (shown in FIG. 3) removed for clarity. The header connector 106 includes a header housing 230 having a mating face 232 that receives the receptacle connector 104 (shown in FIG. 2) and a mounting face 234 for mounting the header connector 106 to the midplane circuit board 102 (shown FIG. 1). The housing 230 includes pairs of opposed shrouds 238 and 240 that surround a cavity 242. The shrouds 238 extend from an end wall 244 that defines the mounting face 234. Guide slots 246 are provided on two opposed shrouds 240 that receive the guide ribs 138 (shown in FIG. 2) on the receptacle connector 104 to orient the receptacle connector 104 with respect to the header connector 106.

A plurality of signal contact cores 250 and ground contact cores 252 extend through the end wall 244. The signal contact cores 250 receive and hold the signal contacts 120, 122 and the ground contact cores 252 receive and hold the ground contacts 124. The signal and ground contact cores 250, 252 are aligned in a pattern of rows and columns. The contact sets 150 (shown in FIG. 3) are received in respective contact cores 250, 252 in a column.

The signal contact cores 250 are generally T-shaped openings having a base section 254 that receives the body 154 (shown in FIG. 3) of the signal contact 120, 122 and a head section 256 that receives the contact pin 170 (shown in FIG. 3) of the corresponding signal contact 120, 122. The base section 254 is wider than the head section 256. The head section 256 is substantially centered with respect to the base section 254. In an exemplary embodiment, only the head section 256 extends entirely through the end wall 244, and the base section 254 has a bottom which may define a mechanical stop for the signal contact 120, 122 as the signal contact 120, 122 is loaded into the contact core 250. For example, when mated with the midplane 102, the inner end 164 (shown in FIG. 3) of the body 154 may bottom against and engage the bottom of the base section 254 to limit further insertion of the corresponding signal contact 120, 122 into the contact core 250. Optionally, prior to mating with the midplane 102, a gap may be formed between the body 154 and the base section 254.

The ground contact cores 252 include generally rectangular-shaped openings that receive the ground contacts 124. During assembly, a tool may be used to hold the ground contacts 124 in position, such as at a proper depth, within the ground contact cores 252 for mating with the midplane 102. Alternatively, a shoulder (not shown) may be provided within the ground contact core 252, and a portion of the ground contact 124 may engage the shoulder to define a stop as the ground contact 124 is mated with the midplane 102.

The contact cores 250, 252 are arranged in columns and rows. The columns extend parallel to the shrouds 238 and the rows extend parallel to the shrouds 240. In an exemplary embodiment, the head sections 256 are aligned with one another and/or with the ground contact cores 252 along column axes 258. The signal contact cores 250 along the column axes 258 are arranged such that the base sections 254 of signal contact cores 250 holding a signal contact pair 152 are staggered on opposite sides of the respective column axis 258. In other words, adjacent signal contact cores 250 are oriented in opposite directions. The head sections 256 are also aligned with one another and/or with the ground contact cores 252 along row axes 260 which are generally orthogonal to the column axes 258. By aligning the head sections 256 and the ground contact cores 252 in columns and rows, the contact pins 170, 182, 200 are also aligned in the columns and rows, which allows the receptacle corrector 104 (shown in FIG. 1) to have contact channels 134 aligned in columns and rows to mate with the header connector 106. It is realized that the contact cores may be slightly off-set with respect to the column axes 258 and/or the row axes 260. For example, because the ground pin 200 may be slightly off-centered with respect to the body, the contact core 252 may be slightly off-centered with respect to the row axis 260. In this manner, each of the signal and ground pins 170, 182, 200 may remain centered along rows and columns.

Figure 5:
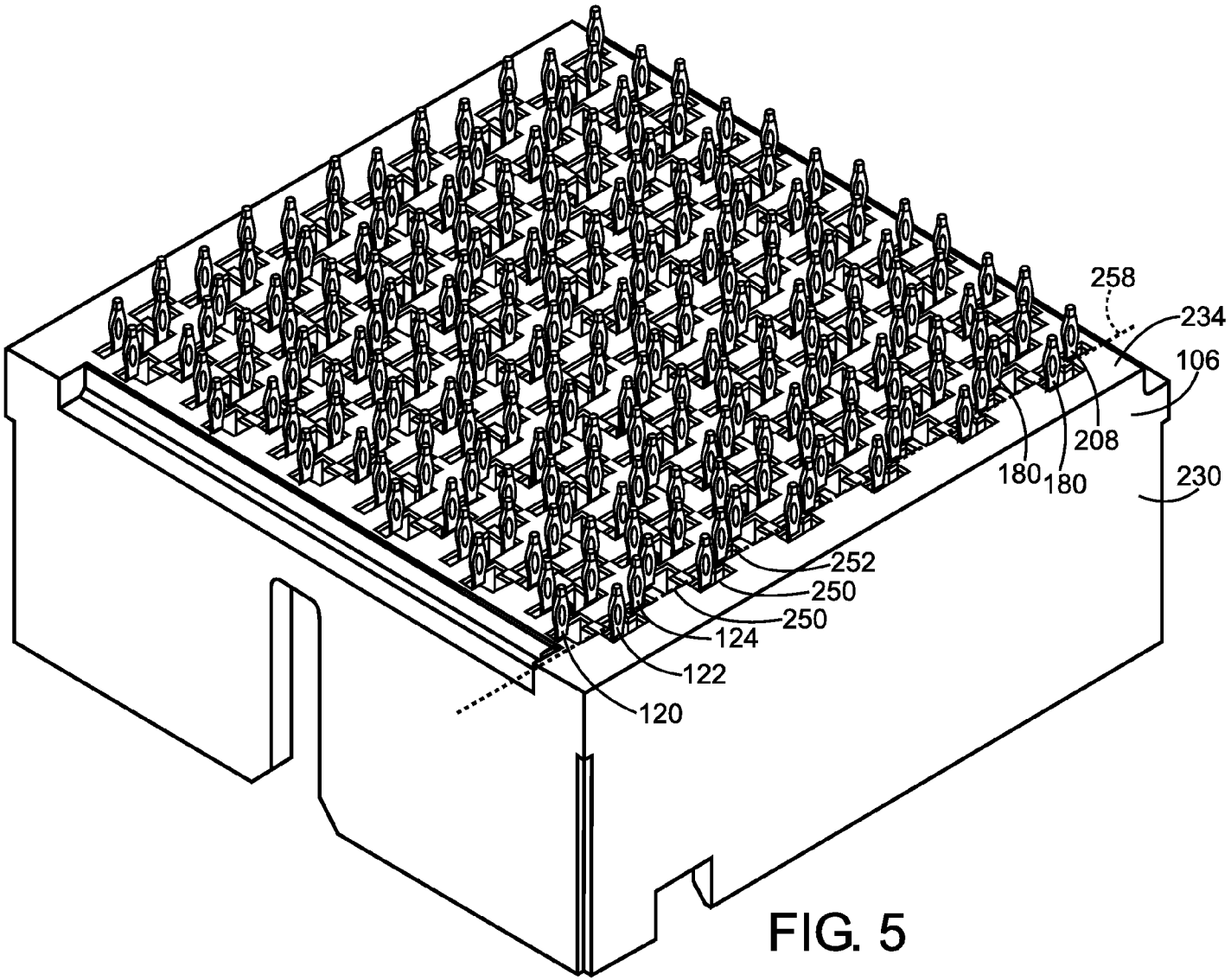
FIG. 5 is a bottom perspective view of the header connector shown in FIG. 1 with the contacts mounted therein.

FIG. 5 is a bottom perspective view of the header connector 106 with the signal and ground contacts 120, 122, 124 mounted therein. In an exemplary embodiment, when the signal and ground contacts 120, 122, 124 are loaded into the contact cores 250, 252, the barbs 168 (shown in FIG. 3) engage the walls defining the contact cores 250, 252 and are held therein by a friction fit. However, the signal and ground contacts 120, 122, 124 may be mounted in the header housing 230 using any suitable method, means, and/or structure. When mounted, the signal contact tails 180, 183 and the ground contact tails 208 protrude from the mounting face 234 and are configured to mate with vias (not shown) in the circuit board midplane 102 (shown in FIG. 1). The signal contact tails 180, 183 in each column are off-set from the respective column axis 258, which is centered along the head sections 256 of the contact cores 250 and/or the contact pins 170 (shown in FIG. 3).

Figure 6:
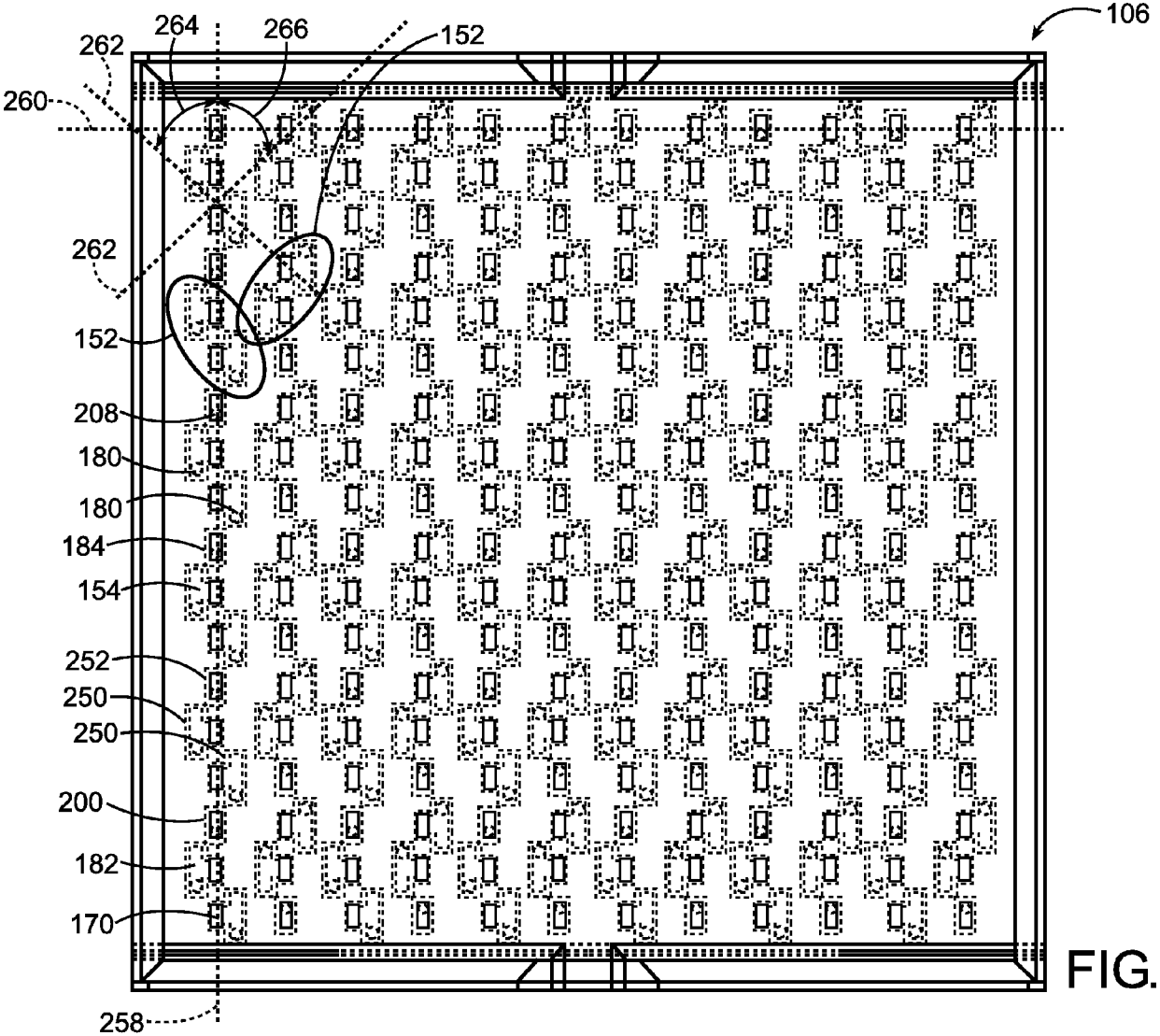
FIG. 6 is a top plan view of the header connector.

FIG. 6 is a top plan view of the header connector 106, illustrating the signal and ground contact pins 170, 182, 200 arranged in columns and rows. A column axis 258 and row axis 260 are illustrated in FIG. 6, and each contact pin 170, 182, 200 is substantially centered along one of the column axes 258 and one of the row axes 260. The signal and ground contact cores 250, 252 are illustrated in phantom in FIG. 6. Additionally, the signal and ground bodies 154, 181, 184 as well as the signal and ground contact tails 180, 183, 208 are also illustrated in phantom to illustrate the relative positions of the signal and ground contact tails 180, 183, 208 with respect to the corresponding contact pins 170, 182, 200.

As described above, the signal contact tails 180, 183 are off-set with respect to the column axes 258 and the signal contact tails 180, 183 of each signal contact pair 152 are staggered on opposite sides of the respective column axis 258. FIG. 6 also illustrates that both the signal and ground contact tails 180, 183, 208 are off-set with respect to the row axes 260. For example, the signal and ground contact tails 180, 183, 208 in each of the odd numbered columns are off-set with respect to the row axes 260 in a first direction and the signal and ground contact tails 180, 183, 208 in each of the even numbered columns are off-set with respect to the row axes 260 in a second direction that is opposite to the first direction. Such off-sets allow the signal and ground contact tails 180, 183, 208 to be mounted to both sides of the midplane circuit board 102 in an orthogonal configuration.

In an exemplary embodiment, a tail axis 262 is defined between the signal contact tails 180, 183 of each signal contact pair 152. The tail axis 262 of each contact pair 152 in the odd numbered columns is skewed from the column axis 258 by a skew angle 264 that is rotated counter-clockwise. The tail axis 262 of each contact pair 152 in the even numbered columns is skewed from the column axis 258 by a skew angle 266 that is rotated clockwise. Optionally, the skew angles 264, 266 may be approximately forty-five degrees such that the tail axes 262 of the contact pairs 152 in the odd numbered columns are generally orthogonal with respect to the tail axes 262 of the contact pairs 152 in the even numbered columns. By orienting the signal contact pairs 152 on a diagonal with respect to the column axis 258 in the odd numbered columns and in a reverse diagonal in the even numbered columns, a greater number of contacts may be provided within a given amount of space and still allow the first and second header connectors 106, 108 to be mounted in an orthogonal configuration. Optionally, the diagonal orientation of the signal contact pairs 152 may provide better electrical performance.

Figure 7:
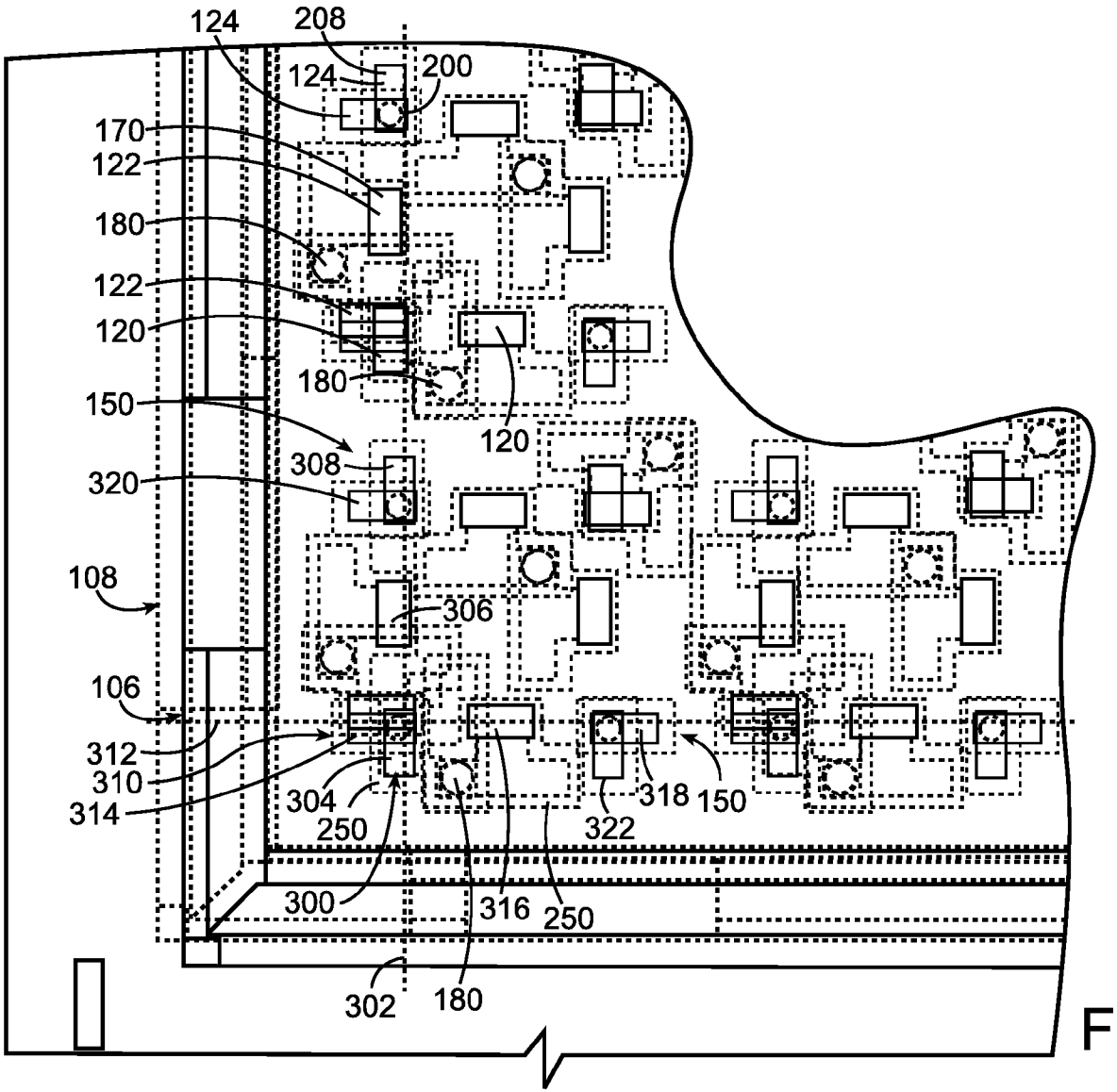
FIG. 7 is an enlarged view of a portion of the header connector shown in FIG. 6.

FIG. 7 is an enlarged view of a portion of the header connector 106 shown in FIG. 6. FIG. 7 further illustrates the second header connector 108 in phantom showing how the signal and ground contacts 120, 122, 124 and the signal and ground contact cores 250, 252 of the second header assembly 108 are arranged with respect to the signal and ground contacts 120, 122, 124 and the signal and ground contact cores 250, 252 of the second header assembly 106. The contact pins 170, 182, 200 of the signal and ground contacts 120, 122, 124 are shaded to illustrate the orientations of the contact pins 170, 182, 200 with respect to one another.

As described above, the header connectors 106, 108 are oriented approximately in line with one another along the longitudinal axis $A_1$ (shown in FIG. 1) such that the header connectors 106, 108 are angularly offset ninety degrees with respect to one another to form an orthogonal connection therebetween. Additionally, each signal contact tail 180, 183 in the first header connector 106 is positioned to be received in a via (not shown) in the midplane circuit board 102 (shown in FIG. 1) that is shared by another signal contact tail 180, 183 in the second header connector 108. That is, the signal contact tails 180, 183 of corresponding signal contacts 120 and/or 122 extend into opposite ends of the same via. For example, in the illustrated embodiment, a first signal contact pair 300 in a first column 302 of the first header connector 106 includes a first signal contact 304 and a second signal contact 306. A first ground contact 308 is also provided within the contact set 150. A second signal contact pair 310 in a first column 312 of the second header connector 108 includes a third signal contact 314 and a fourth signal contact 316. Due to the orthogonal relationship of the header connectors 106, 108, the column 312 of the second header connector 108 is oriented at ninety degrees with respect to the column 302 of the first header connector 108. A second ground contact 318 is also provided within the contact set 150. The first signal contact 304 and the fourth signal contact 316 are oriented within the respective contact cores 250 such that the contact tails 280 thereof are aligned with one another and may be received within a shared via. Similarly, the second signal contact 306 and the third signal contact 314 are oriented within the respective contact cores 250 such that the contact tails 180, 183 thereof are aligned with one another and may be received within a shared via.

Similar to the signal contacts 120, 122, the header connector 106 and the identical header connector 108 may be configured such that the ground contacts 124 of the header connector 106 are also received in common vias with the ground contacts 124 of the header connector 108. The first ground contact 308 of the first header connector 106 is at least partially aligned with a third ground contact 320 of the second header connector 108. The third ground contact 320 is within a second column of the second header connector 108. Similarly, the second ground contact 318 of the second header connector 108 is at least partially aligned with a fourth ground contact 322 of the first header connector 108. The fourth ground contact 322 is within a second column of the first header connector 106.

Figure 8:
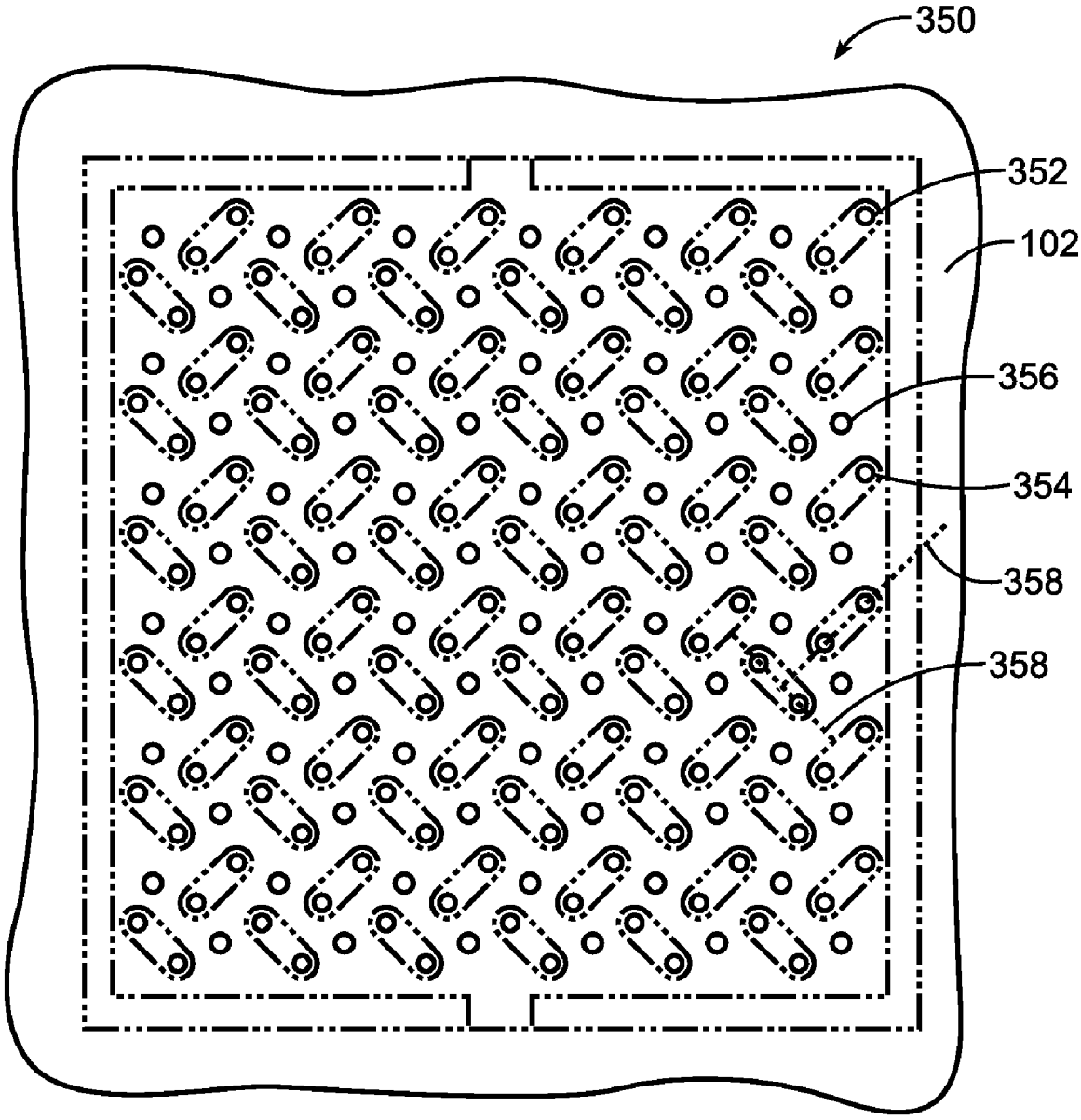
FIG. 8 schematically illustrates a pin pattern of the contacts of the header connector on a midplane circuit board.

FIG. 8 schematically illustrates a pin pattern 350 of vias 352 on the midplane circuit board 102. Optionally, the vias 352 may be through vias, but other types of vias may also be utilized, such as blind vias. The pin pattern of vias 352 corresponds to the pattern of signal and ground contacts 120, 122, 124 (shown in FIG. 5) of the header connector 106. In an exemplary embodiment, the vias 352 include both signal vias 354 that receive contact tails 180, 183 (shown in FIG. 5) of signal contacts 120 or 122 and ground vias 356 that receive contact tails 208 (shown in FIG. 5) of ground contacts 124. The signal vias 354 are associated as pairs that receive the signal contact pairs 152 (shown in FIG. 5). A via axis 358 is defined between the signal vias 354 of the pair. The vias 352 are arranged in columns and rows, with the via axes 358 in the odd numbered columns crossing the column axis at approximately a forty-five degree angle and the via axes 358 in the even numbered columns crossing the column axis at approximately a forty-five degree angle such that the via axes 358 of each pair in the odd numbered columns are generally orthogonal with respect to the via axes 358 of each pair in the even numbered columns.

Figure 9:
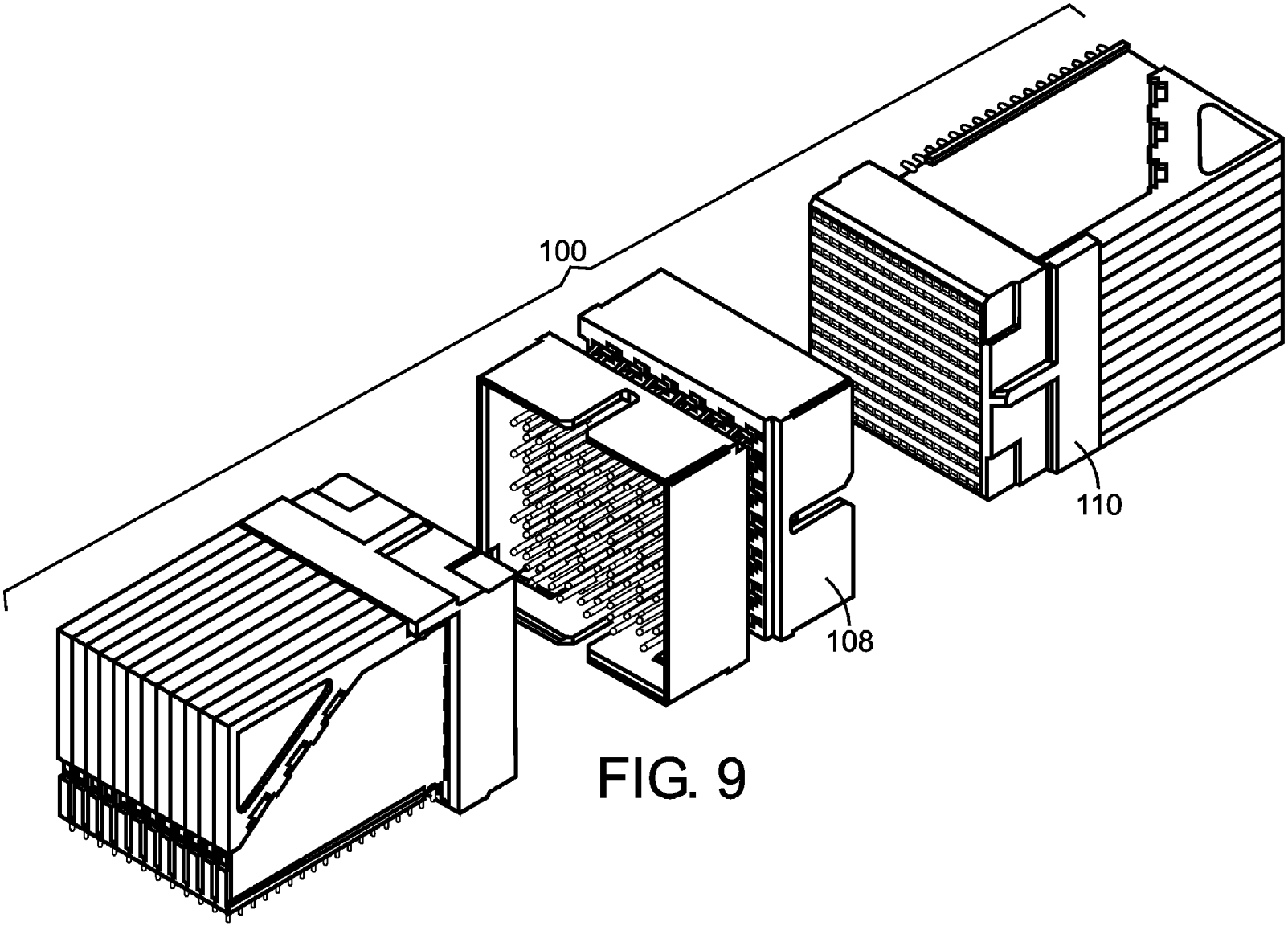
FIG. 9 illustrates the orthogonal connector assembly shown in FIG. 1 using an alternative mounting orientation of one of the receptacle connectors.

FIG. 9 illustrates the orthogonal connector assembly 100 using an alternative mounting orientation of the second receptacle connector 110. The second receptacle connector 110 is oriented approximately 180 degrees with respect to the orientation shown in FIG. 1. The second receptacle assembly 110 is matable with the second header assembly 108 in either orientation.

Figure 10:
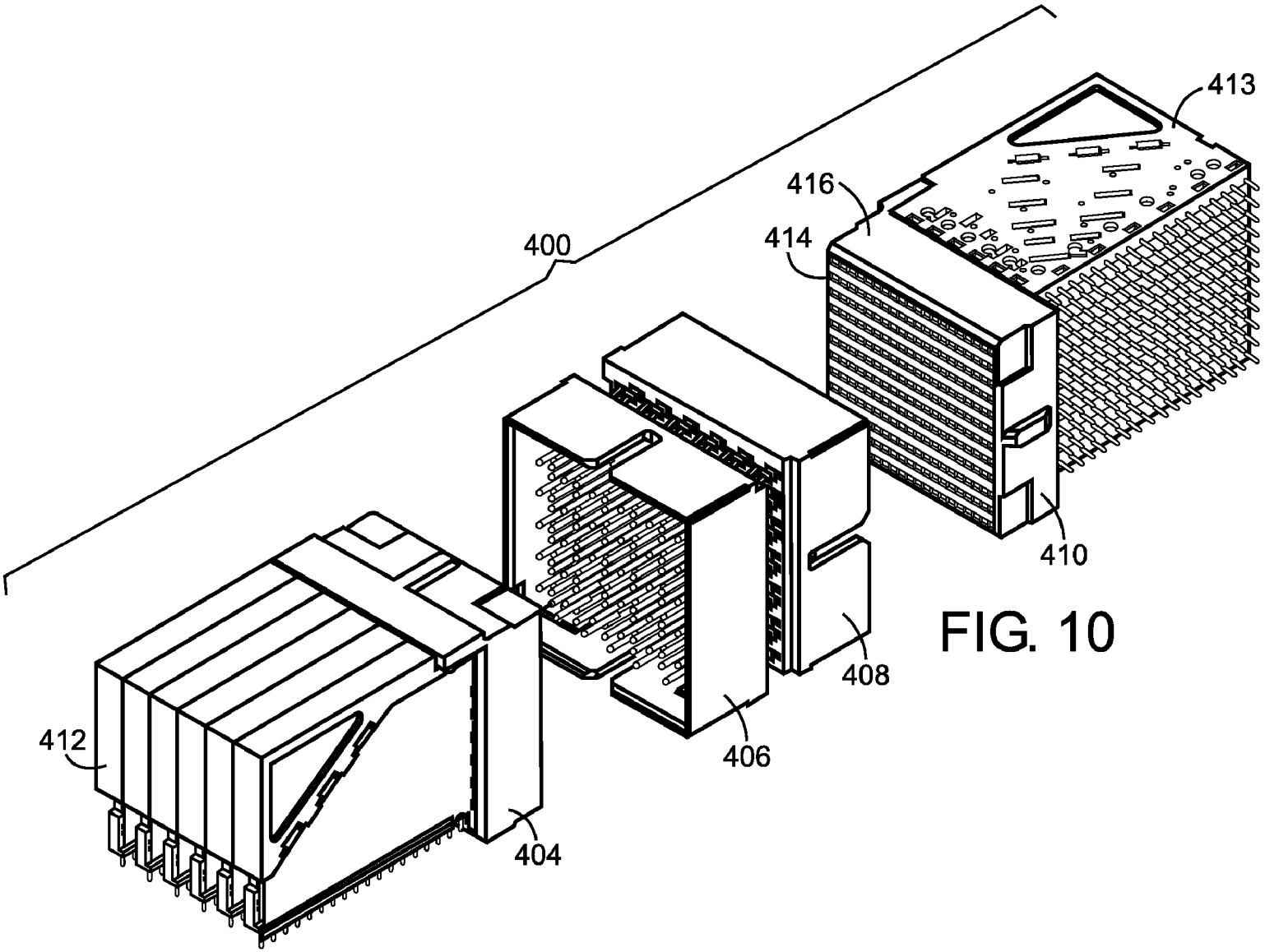
FIG. 10 illustrates an orthogonal connector assembly using alternative receptacle connectors.

FIG. 10 illustrates an orthogonal connector assembly 400 using alternative receptacle connectors 404 and 410 that are matable with header connectors 406, 408 that may be substantially similar to the header connectors 106, 108 illustrated in FIG. 1. The receptacle connectors 404, 410 include contact modules 412, 413, respectively, that are pluggable into every other column of contact channels 414 in a housing 416 of the receptacle connectors 404, 410. While the contact modules 412, 413 have a width that covers two columns of the mating cavities of the receptacle connectors 404, 410, the contact modules 412, 413 have mating contacts (not shown) that are off-set to one side or the other such that the mating contacts may be received in one column of mating cavities or the other.

In the illustrated embodiment, the contact modules 412 and 413 are different from one another. For example, the contact modules 412 include a leadframe and associated mating contacts that are off-set or shifted to the right when viewed from the rear. Each of the contact modules 412 define B-type contact modules 412. However, the contact modules 413 include a leadframe and associated mating contacts that are off-set or shifted to the left when viewed from the rear. Each of the contact modules 413 define A-type contact modules 413. By using different types of contact modules 412, 413, and due to the configuration of the signal and ground contacts of the header assemblies 406, 408, the mating contacts of the receptacle assemblies 404, 410 mate with corresponding signal and ground contacts of the header assemblies that share vias.

Figure 11:
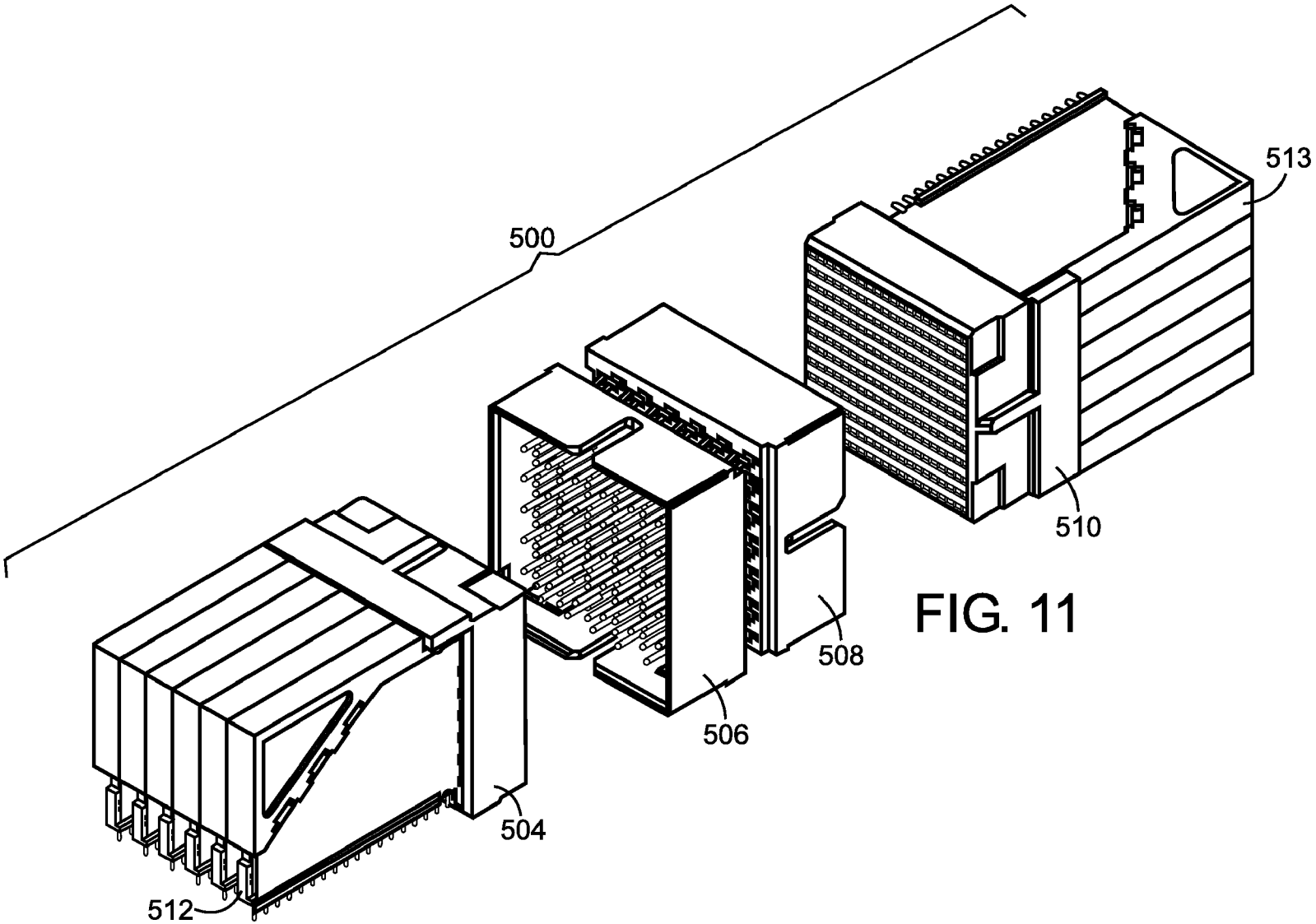
FIG. 11 illustrates another orthogonal connector assembly using alternative receptacle connectors.

FIG. 11 illustrates an orthogonal connector assembly 500 using alternative receptacle connectors 504 and 510 that are matable with header connectors 506, 508 that may be substantially similar to the header connectors 106, 108 illustrated in FIG. 1. In the illustrated embodiment, the receptacle connectors 504, 510 are identically formed and are substantially similar to the receptacle connector 404 illustrated in FIG. 10. In contrast to the embodiment illustrated in FIG. 10, the receptacle connector 510 is oriented in a different position that is rotated approximately 180 degrees with respect to the receptacle connector 410.

The receptacle connectors 504, 510 include contact modules 512, 513, respectively, that are of the same type, such as both B-type contact modules. In other words, the contact modules 512, 513 include a leadframe and associated mating contacts that are off-set or shifted to the right when viewed from the rear. By using the same type of contact modules 512, 513, and due to the configuration of the signal and ground contacts of the header assemblies 506, 508, the mating contacts of the receptacle assemblies 404, 410 mate with corresponding signal and ground contacts of the header assemblies that share vias. It is realized that the receptacle connectors 504, 510 may both include A-type contact modules rather than B-type contact modules in an alternative embodiment.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a mating face and a mounting face; and a plurality of signal contacts held by the housing, the signal contacts being arranged in differential pairs to form signal contact pairs, each signal contact having a body, a contact pin extending from one end of the body along a pin axis, and a contact tail extending from an opposite end of the body, the body and contact tail extending along a contact plane, the contact pin including a transition section that off-sets the contact pin out of the contact plane in a first lateral direction, and the contact tail lying in the contact plane and being off-set in a transverse direction with respect to the pin axis;

a ground contact has a ground contact body, a ground contact pin and a ground contact tail being generally co-planar with one another, the ground contact tail extending from the ground contact body in an opposite direction as the ground contact pin and being off-set with respect to a ground pin axis.

2. The electrical connector of claim 1, wherein the contact pins within the signal contact pair are off-set from the bodies in opposite directions.

3. The electrical connector of claim 1, wherein the contact tails within the signal contact pair are off-set with respect to a central plane of each body in the same direction.

4. The electrical connector of claim 1, wherein the contact pin extends generally parallel to the contact plane and off-set from the contact plane.

5. The electrical connector of claim 1, wherein the pin axis is substantially centered with respect to the body.

6. The electrical connector of claim 1, wherein each differential pair includes a first signal contact and a second signal contact, wherein one of the contact tail and the contact pin of the first signal contact is off-set in an opposite direction as compared to the second signal contact.

7. The electrical connector of claim 1, wherein the body extends along the contact plane between a first edge and a second edge, the contact tail being positioned proximate to one of the first edge and the second edge.

8. An electrical connector comprising:

a plurality of signal contacts being arranged in differential pairs to form signal contact pairs, each signal contact having a body, a contact pin extending from one end of the body and a contact tail extending from an opposite end of the body, the contact pins being substantially centered with respect to the body and the contact tails being non-centered with respect to the body; and a header housing having an end wall defining a mounting face, the end wall having a plurality of contact cores extending therethrough that receive the signal contacts, the contact cores being aligned in a pattern of rows and columns, each contact core having a base section that receives the body of the signal contact and a head section that receives the contact pin of the signal contact, wherein the head sections are substantially centered along the base sections, and wherein the head sections are aligned with one another along row axes and column axes such that the contact pins are aligned with one another, the contact cores along the column axes being arranged such that the base sections of contact cores holding a signal contact pair are staggered on opposite sides of the respective column axes.

9. The electrical connector of claim 1, wherein the contact tails protrude from the mounting face and are configured to mate with vias in the circuit board.

10. An electrical connector assembly including a pair of connectors configured to be electrically connected to one another from opposite sides of a circuit board, the electrical connector assembly comprising:

first and second connector housings each having a mating interface and a mounting interface, the mounting interfaces being configured to be electrically connected to one another from opposite sides of the circuit board approximately in line with one another along a longitudinal axis such that the connector housings are angularly offset ninety degrees about the longitudinal axis with respect to one another; and signal and ground contacts held in the first and second connector housings, the signal contacts being arranged in differential pairs to form signal contact pairs, each signal contact having a signal contact tail off-set with respect to a centerline of the signal contact and each ground contact having a ground contact tail off-set with respect to a centerline of the ground contact;

wherein the signal and ground contacts are configured to be received in respective vias in the circuit board such that the signal contact tails of corresponding signal contacts of the first connector and the second connector are received in a shared via;

wherein each signal contact includes a signal contact body and a signal contact pin extending from an end of the signal contact body and each ground contact includes a ground contact body and a ground contact pin extending from an end of the ground contact body, wherein the signal and ground contact pins are arranged in a first pattern at the mating interface and the signal and ground contact tails are arranged in a second pattern at the mounting interface, and wherein the signal and ground contact pins are arranged in columns along column axes and adjacent columns are aligned with one another such that the signal and ground contact pins are arranged in rows along row axes;

wherein a tail axis is defined between the signal contact tails of each signal contact pair, the tail axes in adjacent columns being orthogonal to one another.

11. The electrical connector assembly of claim 10, wherein each signal contact includes a generally planar body and a contact pin extending from the body, the contact pin being substantially aligned with respect to the centerline of the signal contact and the contact pin being off-set from the body in a lateral direction such that the contact pin is non-planar with respect to the body.

12. The electrical connector of claim 8, wherein the base section extends between opposed ends, the signal contacts are held within the contact cores such that the contact tails are positioned proximate one of the ends defining the base section.

13. The electrical connector assembly of claim 10, wherein the signal contact tails of each signal contact pair being staggered at a skew angle with respect to the respective row axis and the respective column axis.

14. The electrical connector assembly of claim 10, wherein a tail axis is defined between the signal contact tails of each signal contact pair, the tail axis being formed at approximately a forty-five degree angle with the respective column axis.

15. The electrical connector of claim 8, wherein the signal contacts are loaded into respective contact cores in every other column of contact cores.

16. The electrical connector assembly of claim 10, wherein the signal contact tails in odd numbered columns are each off-set with respect to the row axis in a first direction and the signal contact tails in even numbered columns are each off-set with respect to the row axis in a second direction.

17. The electrical connector of claim 8, further comprising a plurality of ground contacts, the header housing further comprises a plurality of ground contact cores being aligned along the row axes and column axes.

* * * * *